US011771949B2

(12) United States Patent
Chen

(10) Patent No.: US 11,771,949 B2
(45) Date of Patent: Oct. 3, 2023

(54) REALISTIC SLOPING SIMULATION DEVICE FOR FITNESS EQUIPMENT

(71) Applicant: Shui Jung Chen, New Taipei (TW)

(72) Inventor: Shui Jung Chen, New Taipei (TW)

( * ) Notice: Subject to any disclaimer, the term of this patent is extended or adjusted under 35 U.S.C. 154(b) by 248 days.

(21) Appl. No.: 17/151,996

(22) Filed: Jan. 19, 2021

(65) Prior Publication Data

US 2021/0220697 A1 Jul. 22, 2021

(30) Foreign Application Priority Data

Jan. 21, 2020 (TW) ..... 109102278

(51) Int. Cl.
*A63B 22/06* (2006.01)
*A63B 22/00* (2006.01)

(52) U.S. Cl.
CPC ..... *A63B 22/0605* (2013.01); *A63B 22/0046* (2013.01)

(58) Field of Classification Search
CPC ..... A63B 22/0605; A63B 21/4035; A63B 21/0052; A63B 21/0058; A63B 24/0062; A63B 71/0622; A63B 21/00069; A63B 21/00076; A63B 21/005; A63B 21/225; A63B 22/0046; A63B 24/0087; A63B 23/0476; A63B 2071/0677; A63B 2220/05; A63B 2220/807; A63B 2225/096; A63B 2071/0638; A63B 2022/0623; A63B 2225/09; A63B 2024/0093; A63B 2225/093; A63B 2022/0617; A63B 2022/0033; A63B 2022/0641; A63B 2220/64; A63B 2220/80; A63B 2220/833; A63B 2220/18; A63B 2220/30; A63B 2024/009; A63B 2220/10; A63B 2225/20; A63B 2220/803; A63B 2024/0096; A63B 2071/0644; A63B 2220/40; A63B 2209/08; A63B 2225/50

See application file for complete search history.

(56) References Cited

U.S. PATENT DOCUMENTS

| | | | | |
|---|---|---|---|---|
| 7,717,828 | B2 * | 5/2010 | Simonson | A63B 69/182 482/52 |
| 10,004,940 | B2 * | 6/2018 | Badarneh | A63B 21/0051 |
| 10,561,877 | B2 * | 2/2020 | Workman | A63B 22/0046 |
| 11,253,742 | B2 * | 2/2022 | Chen | A63B 22/0046 |
| 2011/0105282 | A1 * | 5/2011 | Pinzon | A63B 22/0605 482/57 |

(Continued)

*Primary Examiner* — Andrew S Lo
*Assistant Examiner* — Andrew M Kobylarz
(74) *Attorney, Agent, or Firm* — Rosenberg, Klein & Lee

(57) ABSTRACT

A realistic sloping simulation device for a fitness equipment is disclosed, generally including a fixed base, a host tube, a support frame, and a driving unit. The host tube has a first end coupled to the fixed base. The support frame has a lower end slidably coupled to the fixed base and an upper end pivoted to the host tube between the first end and the second end. The driving unit is disposed between the host tube and the support frame or between the host tube and the fixed base. The fixed base, the host tube, and the support frame jointly form a linkage mechanism. By means of the driving unit driving the lower end of the support frame to move relative to the fixed base or the host tube, the second end of the host tube is caused to swing or rotate so as to simulate different slopes.

6 Claims, 6 Drawing Sheets

(56) References Cited

U.S. PATENT DOCUMENTS

| | | | | |
|---|---|---|---|---|
| 2012/0071301 | A1* | 3/2012 | Kaylor | A63B 21/00058 482/57 |
| 2013/0072356 | A1* | 3/2013 | Machida | A63B 22/0605 482/58 |
| 2018/0117383 | A1* | 5/2018 | Workman | A63B 24/0087 |
| 2018/0200566 | A1* | 7/2018 | Weston | A63B 71/0622 |
| 2021/0060380 | A1* | 3/2021 | Hawkins, III | A63B 22/0605 |
| 2021/0197015 | A1* | 7/2021 | Anderson | A63B 22/0605 |

* cited by examiner

REALISTIC SLOPING SIMULATION DEVICE FOR FITNESS EQUIPMENT

BACKGROUND OF THE INVENTION

1. Field of the Invention

The present invention relates to an indoor fitness or exercise equipment, and in particular to a fitness equipment that features simulation of sloping in reality.

2. The Related Arts

Traditional indoor bicycle trainers or exercycles are basically operated in such a manner of controlling a resisting force generated against pedaling to simulate the experience of riding upslope or downslope in the outside. In other words, a resisting device is provided to generate resistance against the motion of a flywheel in order to increase the amount of power required for pedaling and thus simulating an upsloping training operation. However, no matter how the resistance of the resisting device is altered, the rider does not actually perceive a real variation of the body for being forward prone and backward supine.

Bicycle trainers that are capable of simulating sloping are known, such as US Patent Application Publication No. 2019022497, which discloses a "bicycle climbing and descending training device". Such a known training device includes a sloping simulation device mounted to a front fork of a bicycle frame for lifting or lowering the front fork in order to allow a rider to directly perceive the feeling of riding upslope or downslope. However, such a simulation device must be used in combination with a bicycle trainer and a bicycle frame, and include a number of assemblies and components as a whole, making it occupying a large amount of space.

On the other hand, regarding sloping simulation techniques of indoor exercycles, reference can be made to Chinese Utility Publication Nos. 205516192 and 205626870. The two documents both propose a large base and an exercycle is mounted on the base. The base is operable to provide forward and backward inclining to simulate variation of sloping. However, such a base is of a large size, making it hard for spatial arrangement.

Referring to FIG. 1, a schematic view of a known exercycle that is capable of simulating sloping is provided. As shown in the drawing, the exercycle has a seat tube 91 that is provided, on the back side thereof, with an actuator 92 mounted between a base 93 and the seat tube 91. The actuator 92 provides an operation of extension and contraction to drive the seat tube 91 to swing so as to generate an effect of sloping simulation. However, such a known exercycle may be operated for inclination by means of the actuator 92 directly driving the seat tube 91, yet relatively, the actuator 92 has to take a pressing force and loading that the seat tube 91 applies thereto, including the weight of a user and the power output by riding. Thus, when the actuator 92 receives an excessively large force acting thereon, particularly when the rider is overweight or the pedaling power exceeds a limit value, the actuator 92 may get damaged. Further, to drive the seat tube 91 to swing and to hold an angle thereof, the actuator has to apply a relatively enlarged tension force and pulling force. Requirement of specification and capability of the actuator 92 is high, and the cost is thus kept high.

SUMMARY OF THE INVENTION

The primary objective of the present invention is to provide a fitness equipment featuring simulation of sloping in reality, which enables simulation of sloping in reality with a simple mechanism, has high reliability and low cost and occupies no extra space and does not affect the pedaling power of a rider.

To achieve the above objective, the present invention provides a realistic sloping simulation device for a fitness equipment, generally comprising a fixed base, a host tube, a support frame, and a driving unit. The host tube has a first end and a second end. The first end is coupled to the fixed base. The support frame has one end coupled to the fixed base and an opposite end pivoted to the host tube between the first end and the second end. The driving unit is of an arrangement of at least one of being disposed between the host tube and the support frame and being disposed between the support frame and the fixed base. The driving unit drives one end of the support frame to move relative to the fixed base, so as to cause the second end of the host tube to swing or rotate.

In above fitness equipment, the present invention provides a firm and secured linkage mechanism made up of the fixed base, the host tube, and the support frame, and uses the driving unit to drive one end of the support frame to move relative to the fixed base or the host tube, so as to causes another end of the host tube to swing or rotate for simulating various slopes. As such, the present invention has a simple mechanism, is reliable, and the mechanism makes use of leverage so that requirement for driving force is limited and can be operated with a very minute driving force, and the driving unit itself is not susceptible to influence caused by a rider's weight or pedaling force and is thus not easily damaged.

Preferably, the fitness equipment of the present invention is structured such that a distance between the site where the support frame is pivoted to the host tube and the first end of the host tube is greater than a distance between the site and the second end of the host tube, such that based on leverage, the driving unit, through applying just a driving force that is smaller than the loading, may drive the host tube to swing or rotate, so as to reduce the requirement for loading and specification for the driving unit.

Further, the present invention uses an actuator as the driving unit, which comprises a fixed end, and a free end. The fixed end is connected to the host tube, and the free end is connected to the support frame. However, in the present invention, any device or mechanism that can drive one end of the support frame to do linear reciprocal motion can be used as the actuator, such as a linear stepping motor, a pneumatic cylinder, a hydraulic cylinder, or other mechanisms that provide a linear reciprocal motion, such as a ball screw, a toothed rack, a transmission belt, or a metallic band that is used in combination with an electrical machine.

Further, the present invention may further comprise a pedaling module, a top tube, a seat, and a handlebar. The pedaling module is mounted on the host tube. The top tube is mounted to the second end of the host tube. The seat and the handlebar are respectively mounted to two ends of the top tube. Further, in the present invention, the pedaling module may further comprise a pedal, a flywheel, and a resistance generation device. The pedal is operable to drive the flywheel to rotate. The resistance generation device functions to generate and applies a resisting force against the rotation of the flywheel. In other words, the present invention is structured as an indoor exercycle; however, the present invention is not limited thereto and the present invention is equally applicable to any fitness equipment that requires simulation of variation of sloping or variation of inclination angle, such as a spinner bike, a treadmill, an elliptical trainer, a rowing machine, a stair climber, a golf simulator, a stepper, a sit-up, a balancing machine, a riding machine, and a surfing machine.

Further, the present invention comprise a control module, which comprises a main controller, an actuator control unit, a resistance control unit, a memory unit, and a data transmission unit. The actuator control unit, the resistance control unit, the memory unit, and the data transmission unit are all electrically connected with the main controller. The actuator control unit functions to drive activation and de-activation of the driving unit. The resistance control unit functions to control the resistance generation device to generate and apply a resisting force to the flywheel. Further, the data transmission unit is connectable, in a wired manner or a wireless manner, to an external electronic device to receive a training program transmitted from the external electronic device. The memory unit stores the training program. The main controller is operable to control the operations of the actuator control unit and the resistance control unit in a wired manner or wireless manner according to the training program. In other words, the external electronic device may be used to transmit a training program that includes a training course to the device of the present invention, and the device of the present invention may perform simulation of sloping in reality according to the training course, namely synchronously adjusting the resistance of the flywheel and the inclination angle of the sloping.

DETAILED DESCRIPTION OF THE PREFERRED EMBODIMENTS

The present invention provides a realistic sloping simulation device for a fitness equipment. Before a description is provided for embodiments of the present invention, it is noted that in the following description, similar components/parts are designated with similar reference signs. Further, the drawings provided for the present invention are just for illustration in a schematic way and are not drawn to scale, and the drawings may not show all the details. Further, the following description is provided with an indoor pedaling exercycle as an example for illustration; however, the present invention is not limited thereto, and the present invention is applicable to all fitness equipment that require variation of sloping or variation of inclination angle.

Figure 1:
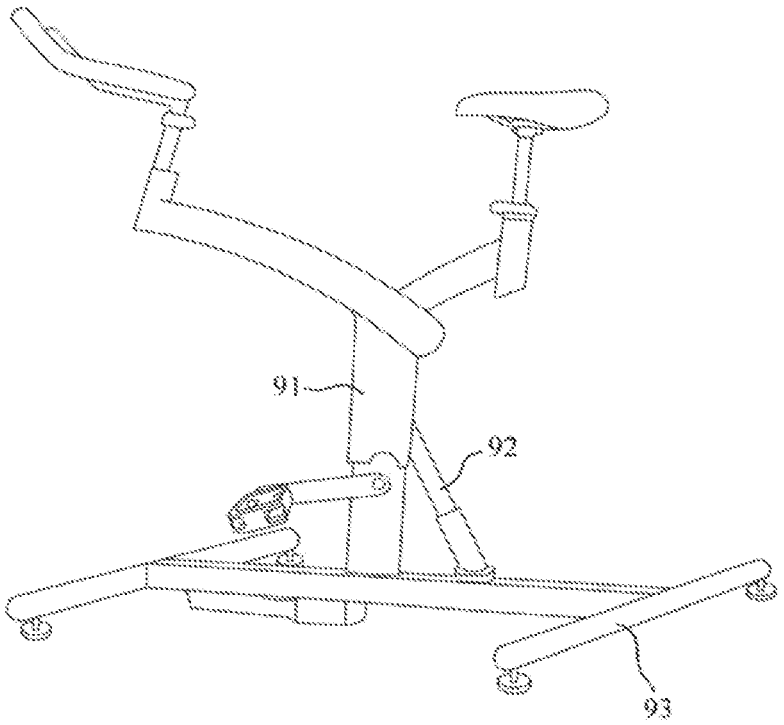
FIG. 1 (Prior Art)
FIG. 1 is a schematic view showing a known exercycle that is capable of simulating sloping.
Figure 2:
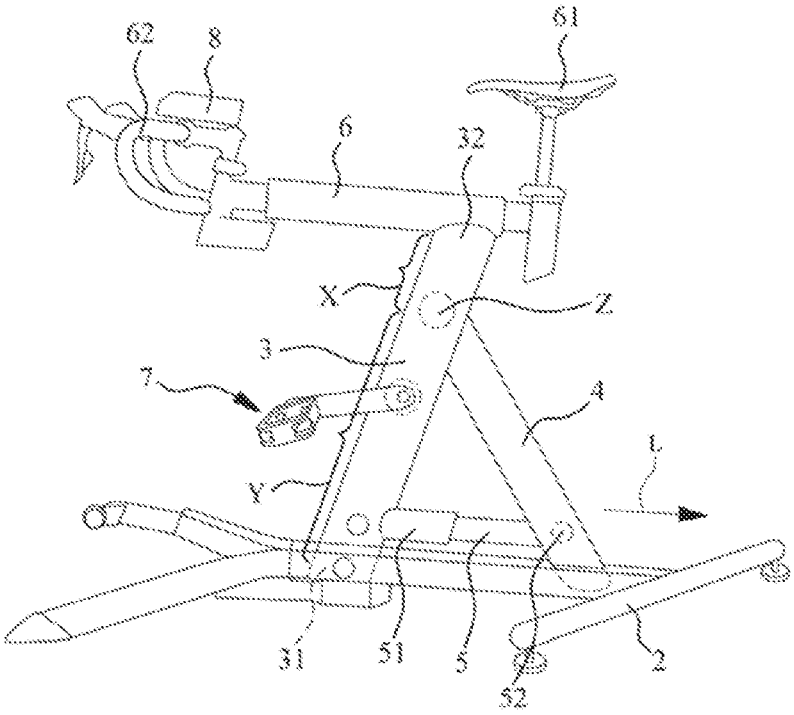
FIG. 2 is a schematic view showing a first embodiment of the present invention, with a rear wheel and a resisting device removed.
Figure 3:
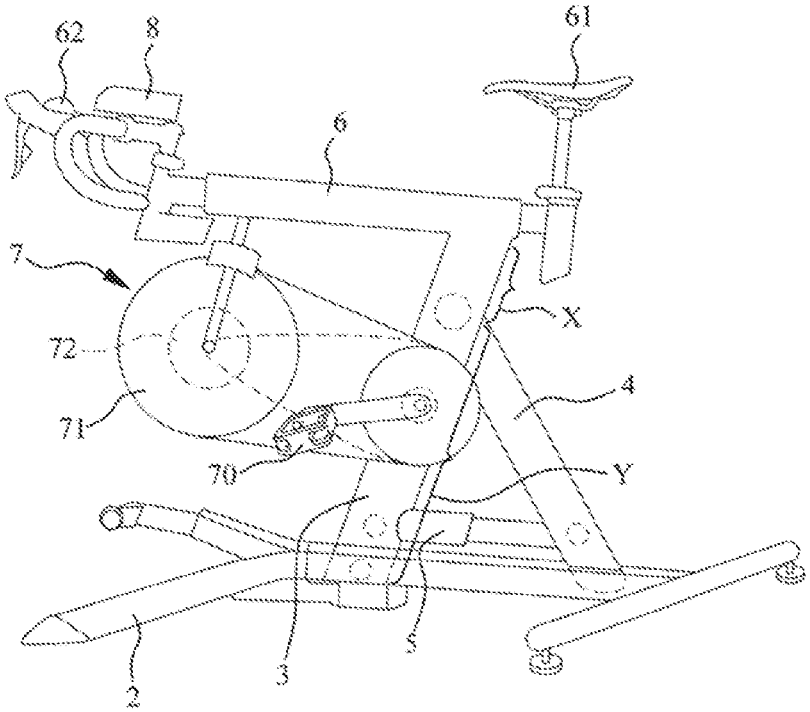
FIG. 3 is a schematic view showing an exercycle according to the first embodiment of the present invention.

Referring first to FIGS. 2 and 3, FIG. 2 is a schematic view showing a realistic sloping simulation device according to a first embodiment of the present invention, with a rear wheel and a resisting device removed; and FIG. 3 is a schematic view showing an exercycle according to the first embodiment of the present invention. As shown in the drawings, the instant embodiment generally comprises a fixed base 2, a host tube 3, a support frame 4, and a driving unit 5. The fixed base 2 is a stable base having a weight and can be of a design of an H-shape or a Y-shape or a combination thereof or other configurations capable of stably supporting, in order to increase the stability thereof.

The host tube 3 has a first end 31 and a second end 32. The first end 31 is pivoted to the fixed base 2, such that the second end 32 of the host tube 3 is rotatable about a center defined by the first end 31 as being driven. The support frame 4 has a lower end that is slidably coupled to the fixed base 2. For example, the lower end of the support frame 4 includes an arc or curved end surface, while the fixed base 2 is formed with a guide groove (not shown) corresponding to the arc or curved end surface, so that the lower end of the support frame 4 is coupled, through sliding engagement achieved with the arc or curved end surface, to the guide groove of the fixed base 2, and thus, the lower end of the support frame 4 is guided by the guide groove to do a motion of linear displacement or movement. The support frame 4 has an upper end that is pivoted to a supporting point Z between the first end 31 and the second end 32 of the host tube 3.

In the instant embodiment, the driving unit 5 is an actuator, and has a fixed end 51 and a free end 52, wherein the fixed end 51 is connected to the host tube 3 and the free end 52 is connected to the lower end of the support frame 4. When the driving unit 5 drives the lower end of the support frame 4 to move in a sliding direction defined by the fixed base 2 (which corresponds to a moving direction of the free end 52 of the driving unit 5), the second end 32 of the host tube 3 swings or rotates about the rotation center defined by the first end 31, so as to simulate variation of sloping.

In the instant embodiment, a distance Y between the site where the support frame 4 is pivoted to the host tube 3 and the first end 31 of the host tube 3 is greater than a distance X between said site and the second end 32 of the host tube 3. The driving unit 5 is arranged at a location adjacent to the fixed base 2, meaning the free end 52 of the driving unit 5 is relatively close to the first end 31 of the host tube 3. As such, based on the theory of cantilever, a small force may change a relatively heavy loading weight. Thus, the quality of the indoor bicycle trainer or exercycle can be improved and the cost saved. Taking FIG. 2 as an example, assuming the supporting point Z functions as a rotation center and the distances to the two ends are respectively X and Y, then:

$$F1*X=F2*Y; \qquad \text{Formula}$$

Loading weight $F1=60\ kg$;

Distance $X=1$;

Distance $Y=3$;

The driving unit 5 provides a force F2=60*1/3=20 kg.

During a riding operation of the exercycle, in addition to the human body weight, the work (watt) performed by the human body is the true purpose of exercise training: $P=NW*\omega\theta$, where $\omega$ is angular velocity.

The instant embodiment is described by taking an indoor exercycle as an example, so that the instant embodiment includes a pedaling module 7, which comprises a pedal 70, a flywheel 71, and a resistance generation device 72. The pedal 70 is operable to drive the flywheel 71 to rotate, and the resistance generation device 72 functions to generate and apply a resisting force against the rotation of the flywheel 71. Further, a top tube 6 is mounted to the second end 32 of the host tube 3 and has two opposite ends that are respectively provided with a seat 61 and a handlebar 62. It is noted that in the instant embodiment, the connection of the top tube 6 to the host tube 3 is not made perpendicular and is rather set at a specific angle, wherein the top tube 6, the host tube 3, and the fixed base 2 jointly form a Z-shape, so as to comply with a triangular arrangement between a top tube and a host tube of a regular bicycle, making it meet ergonomics for a rider to thereby achieve, altogether, an effect of virtual reality for exercise.

Figure 4:
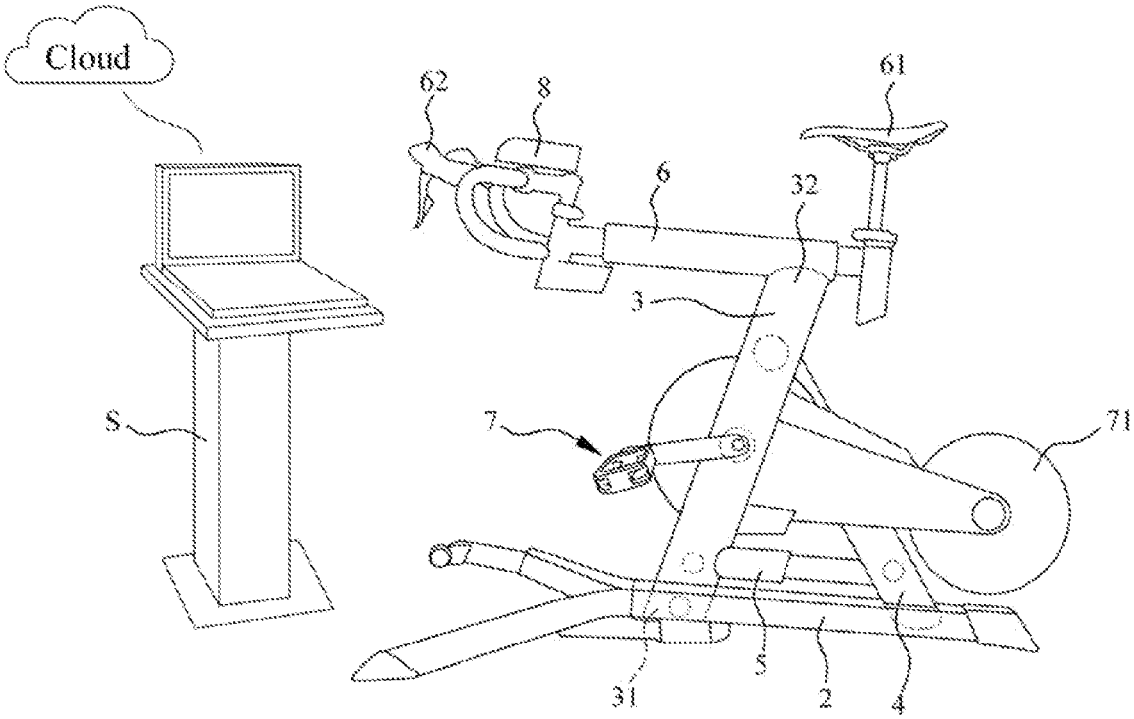
FIG. 4 is a schematic view showing an exercycle according to a second embodiment of the present invention.

Referring to FIG. 4, which is a schematic view showing an exercycle according to a second embodiment of the present invention, the second embodiment is different from the first embodiment only in that the flywheel and chain wheel are provided with different configurations, and in the instant embodiment, training data can be transmitted through a working station S to the cloud for analysis and storage of the training data.

Figure 5:
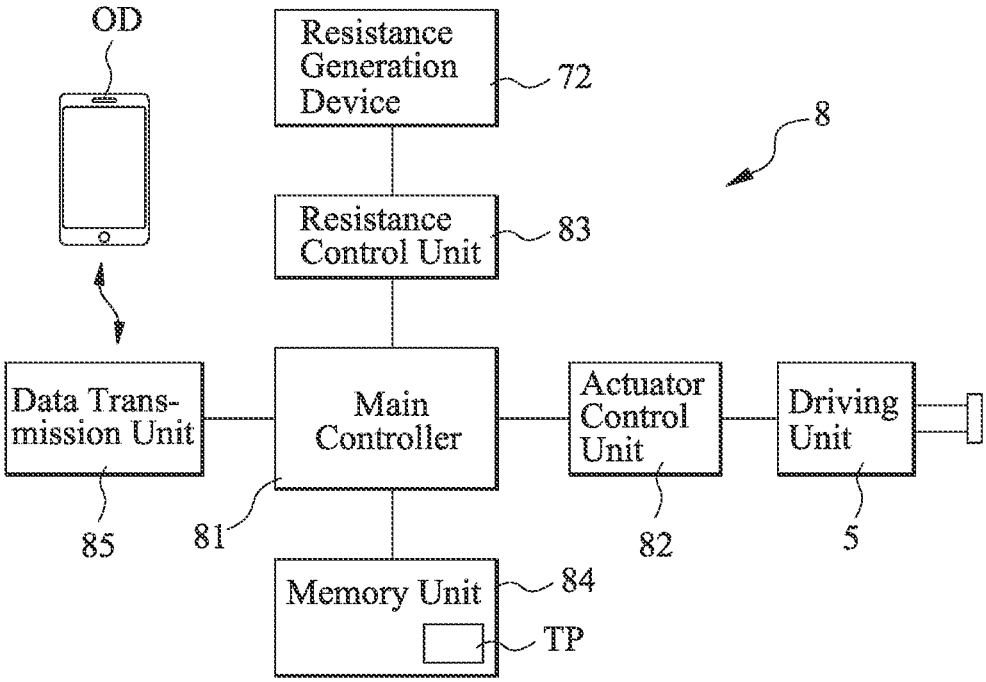
FIG. 5 is a system block diagram of the exercycle according to the first embodiment of the present invention.

The following provides a description to a control module 8 of the instant embodiment, reference being also had to FIG. 5, which is a system block diagram of the exercycle according to the first embodiment of the present invention. As shown in FIG. 5, in the instant embodiment, the control module 8 generally comprises a main controller 81, an actuator control unit 82, a resistance control unit 83, a memory unit 84, and a data transmission unit 85. The actuator control unit 82, the resistance control unit 83, the memory unit 84, and the data transmission unit 85 are all electrically connected with the main controller 81. Further, the driving unit 5 is electrically connected with the actuator control unit 82, and the resistance generation device 72 is electrically connected with the resistance control unit 83.

The actuator control unit 82 functions to activate or de-activate the driving unit 5. The resistance control unit 83 functions to control the resistance generation device 72 to generate and apply a resisting force to the flywheel 71. The data transmission unit 85 is connected, in a wired manner or a wireless manner, to an external electronic device OD, in order to receive a training program TP transmitted from the external electronic device OD. The memory unit 84 stores the training program TP. The main controller 81 controls, in a wired manner or wireless manner, operations of the actuator control unit 82 and the resistance control unit 83 according to the training program TP.

The operation of the instant embodiment will be provided below. Firstly, a user may edit or modify the training program TP by himself, or may download a training program TP provided by another person through a network. The training program TP can be parameters related to an actual route of riding (such as a mountainous road), including road length, slope, and even road surface condition. Next, the user uses the external electronic device OD to transmit the training program TP to the control module 8, so that the main controller 81 may first stores the training program TP in the memory unit 84. Further, when the user starts to operate the fitness equipment of the instant embodiment and load in the training program TP for beginning pedaling, the main controller 81 follows the related parameters provided in the training program TP to synchronously control the resistance generation device 72 and the actuator control unit 82, meaning simulating variation of sloping and pedaling resistance corresponding thereto according to the mileage that the rider has ridden corresponding to the actual road.

Figure 6:
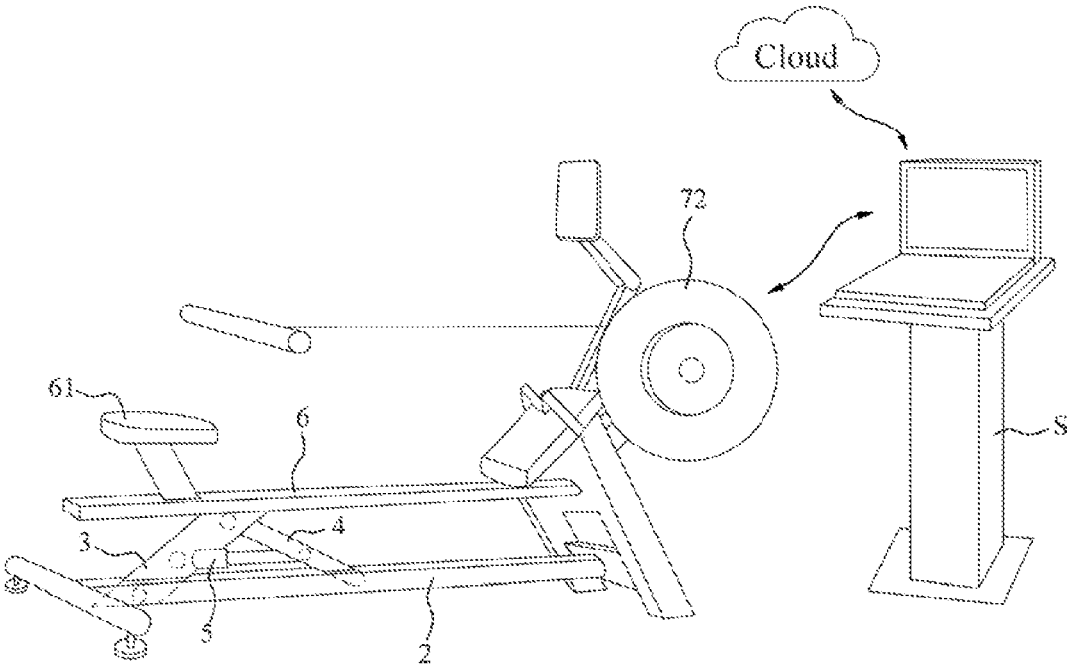
FIG. 6 is a schematic view showing a rowing machine according to a third embodiment of the present invention.

Referring to FIG. 6, which is a schematic view showing a rowing machine according to a third embodiment of the present invention, the instant embodiment demonstrates that the present invention is equally applicable to a rowing machine. When the driving unit 5 drives one end of the support frame 4 to slide relative to the fixed base 2, the host tube 3 drives the top tube 6 and the seat 61 to swing or rotate. As such, perception of inclination of a true boat acted upon by waves can be simulation in reality. Further, in the instant embodiment, training data can be similarly transmitted through a working station S to the cloud for analysis and storage of the training data.

Figure 7:
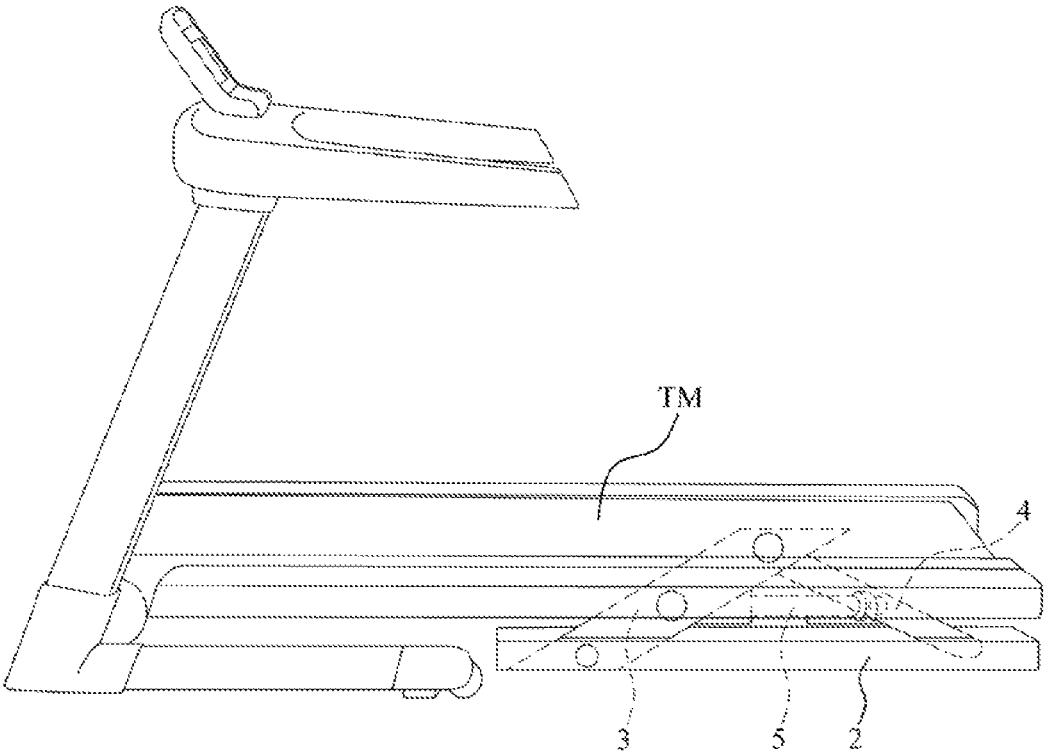
FIG. 7 is a schematic view showing a treadmill according to a fourth embodiment of the present invention.

Referring to FIG. 7, which is a schematic view showing a treadmill according to a fourth embodiment of the present invention, the instant embodiment demonstrates the present invention is equally applicable to a treadmill. Similarly, when the driving unit 5 drives one end of the support frame 4 to slide relative to the fixed base 2, the host tube 3 drives the entirety of the treadmill TM to swing or rotate. As such, different sloping may be simulated in reality to perceive the training of jogging or running.

Figure 8A:
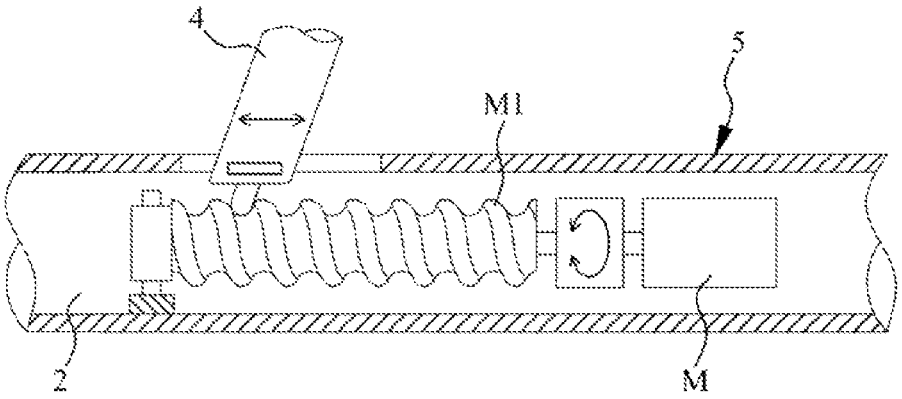
FIGS. 8A, 8B, and 8C are cross-sectional view showing three alternative actuators of different configurations according to the present invention.
Figure 8B:
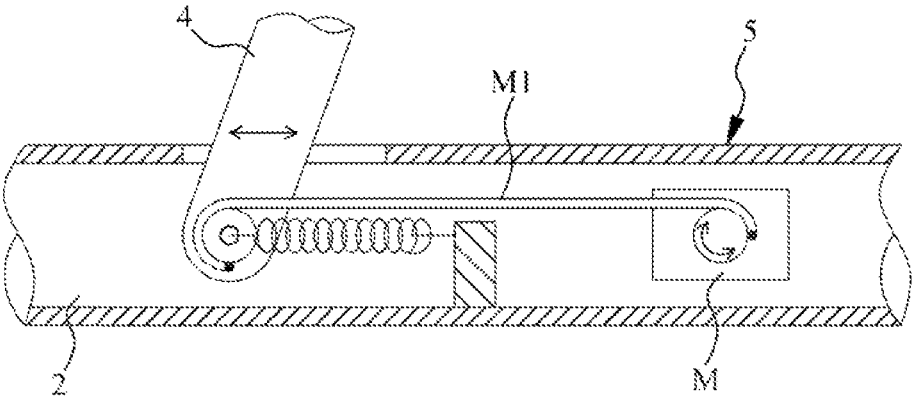
Figure 8C:
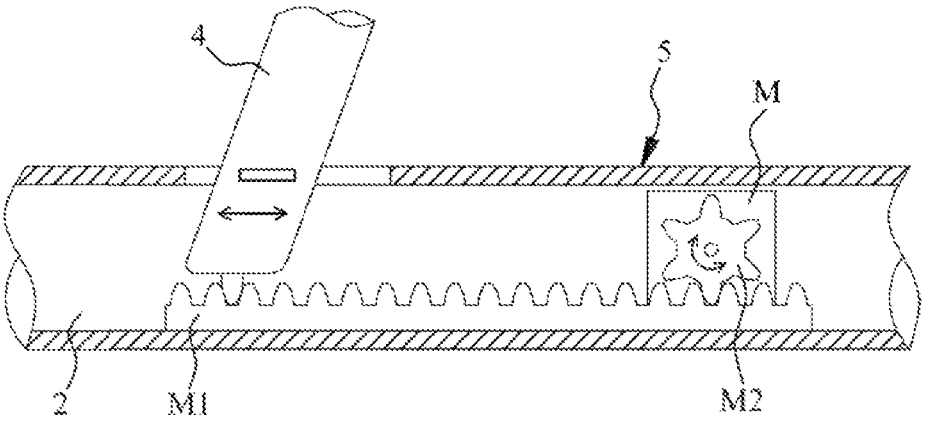

Referring jointly to FIGS. 8A, 8B, and 8C, three alternative driving units 5 of different configurations according to the present invention are shown. Taking the configuration shown in FIG. 8A as an example, the driving unit 5 comprises a motor M and a transmission member M1. In the example, the transmission member M1 comprises a screw rod. One end of the support frame 4 is provided with an engagement tooth, which is mating and coupled to the screw rod, so that when the motor M drives the transmission member M1 to rotate, one end of the support frame 4 is driven to do a linear motion, which in turn drives the host tube 3 (see FIG. 2) to swing or rotate.

Taking the configuration shown in FIG. 8B as an example, in the example, the transmission member M1 comprises a metallic transmission belt, which has an end connected to one end of the support frame 4 and an opposite end connected to a driving spindle of the motor, so that when the motor M drives the transmission member M1 to rotate, one end of the support frame 4 is driven to do a linear motion. Of course, the configuration of the example may be such that a spring is disposed between one end of the support frame 4 and the fixed base 2 to assist the one end of the support frame 4 to return in position.

In the configuration shown in FIG. 8C, the transmission member M1 comprises a toothed rack, and the motor M is provided, on a driving spindle thereof, with a toothed wheel M2. One end of the support frame 4 is similarly provided with an engagement tooth, which is mating and coupled to the toothed rack. The toothed rack is also mating and coupled to the toothed wheel M2. As such, when the toothed wheel M2 of the motor M drives the transmission member M1 to move, one end of the support frame 4 is driven to do a linear motion.

Figure 9:
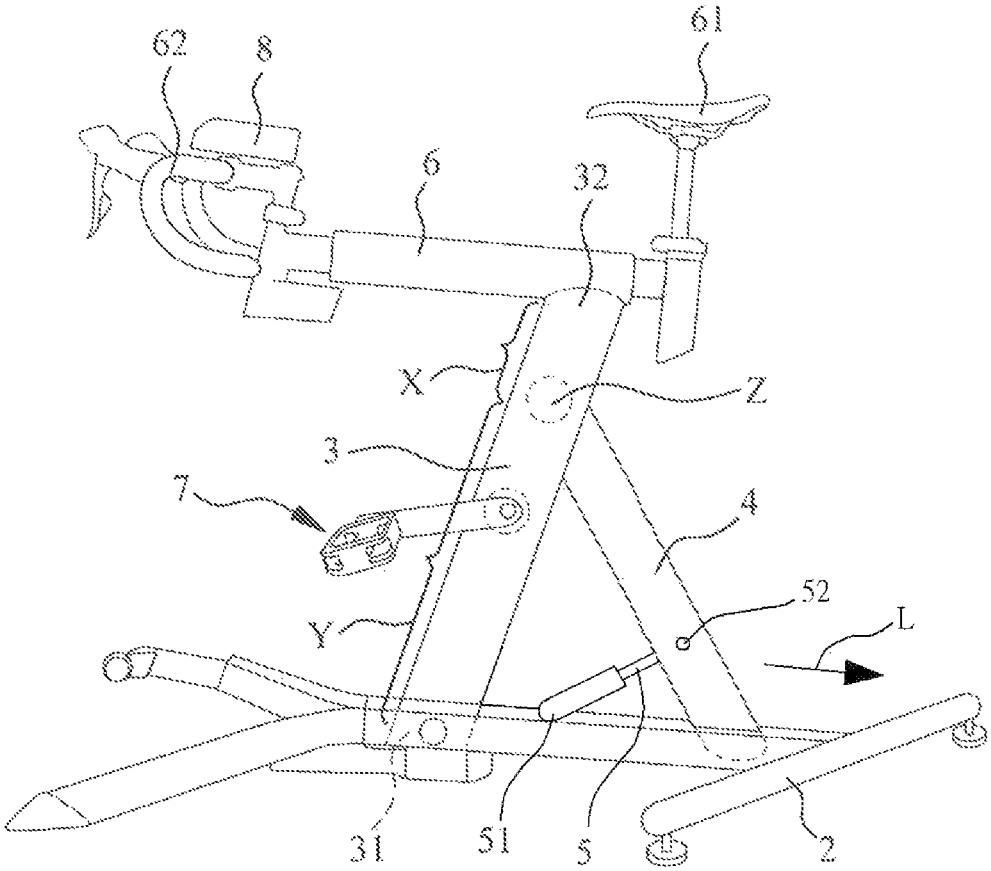
FIG. 9 is a schematic view showing an exercycle according to a fifth embodiment of the present invention.

The embodiments described above use an actuator as the driving unit 5, which is disposed between the support frame 4 and the host tube 3, but the present invention is not limited thereto. The driving unit 5 may be alternatively disposed between the fixed base 2 and the host tube 3. Referring to FIG. 9, which shows the fixed end 51 of the driving unit 5 is mounted to the fixed base 2, and the free end 52 of the driving unit 5 is pivoted to the support frame 4 at a location preferably adjacent to the lower end of the support frame 4. This similarly realizes driving of the lower end of the support frame 4 to move in the sliding direction L defined by the fixed base 2, to thereby cause the second end 32 of the host tube 3 to swing or rotate about the rotation center defined by the first end 31 of the host tube 3.

The driving unit 5 of the present invention is not limited to what described above with reference the embodiments provided herein. Any driving means, or device or mechanism, that can be disposed between the fixed base 2 and the support frame 4 or between the support frame 4 and the host tube to drive one end of the support frame 4 to linear reciprocal movement relative to the fixed base 2 or the host tube 3 is applicable in the present invention.

The embodiments discussed above are provided only for easy illustration. The scope of protection for the present invention should be determined according to the attached claims and should not be limited to such embodiments.

What is claimed is:

1. A realistic sloping simulation device for a fitness equipment, comprising:

a fixed base;

a host tube having a first end and a second end, the first end being coupled to the fixed base;

a support frame having a lower end slidably coupled to the fixed base and an upper end pivoted to the host tube at a site disposed at a distance X from the second end of the host tube and a distance Y from the first end of the host tube, wherein the distance Y exceeds the distance X, and wherein the distance X>0; and a driving unit disposed between the first end of the host tube and the lower end of the support frame, wherein the driving unit drives the lower end of the support frame to move along a sliding direction defined by the fixed base to cause the second end of the host tube to swing about the first end of the host tube; and a pedaling module mounted directly to the host tube.

2. The realistic sloping simulation device as claimed in claim 1, wherein the driving unit comprises an actuator provided with a fixed end and a free end, the fixed end being connected to the first end of the host tube, the free end being connected to the lower end of the support frame.

3. The realistic sloping simulation device as claimed in claim 1, wherein the driving unit comprises one of a linear stepping motor, a pneumatic cylinder, and a hydraulic cylinder.

4. A realistic sloping simulation device for a fitness equipment, comprising:

a fixed base;

a host tube having a first end and a second end, the first end being coupled to the fixed base;

a support frame having a lower end slidably coupled to the fixed base and an upper end pivoted to the host tube between the first end and the second end; and a driving unit disposed between the first end of the host tube and the lower end of the support frame or between the lower end of the support frame and the fixed base, wherein the driving unit drives the lower end of the support frame to move along a sliding direction defined by the fixed base so as to cause the second end of the host tube to swing about the first end of the host tube, a pedaling module, a top tube, a seat, and a handlebar, the pedaling module being mounted directly to the host tube, the top tube being mounted to the second end of the host tube, the seat and the handlebar being mounted to two opposite ends of the top tube, wherein the pedaling module comprises a pedal, a flywheel, and a resistance generation device, the pedal being operable to rotate the flywheel, wherein the resistance generation device generates and applies a resisting force against the rotation of the flywheel, and a control module, the control module including a main controller, an actuator control unit, a memory unit, a data transmission unit, and a resistance control unit, wherein the actuator control unit and the resistance control unit are electrically connected with the main controller, wherein the actuator control unit activates or de-activates the driving unit, wherein the resistance control unit controls the resistance generation device to generate and apply the resisting force against the flywheel, wherein the memory unit and the data transmission unit are electrically connected with the main controller, and the data transmission unit is connected, in a wired manner or a wireless manner, to an external electronic device to receive a training program transmitted from the external electronic device, wherein the memory unit functions to store the training program, and wherein the main controller controls operations of the actuator control unit and the resistance control unit in a wired manner or a wireless manner, according to the training program.

5. The realistic sloping simulation device as claimed in claim 4, wherein the driving unit comprises a motor and a transmission member, the motor being mounted to the fixed base, the transmission member being coupled to the motor, one end of the support frame being coupled to the transmission member, the motor driving the transmission member to drive one end of the support frame to move relative to the fixed base.

6. The realistic sloping simulation device as claimed in claim 5, wherein the transmission member is selected as at least one of the following: a screw rod, a toothed rack, a toothed wheel, and a metallic transmission belt.

* * * * *